US006440359B1

(12) United States Patent
Parson et al.

(10) Patent No.: US 6,440,359 B1
(45) Date of Patent: Aug. 27, 2002

(54) AL-MG-SI ALLOY WITH GOOD EXTRUSION PROPERTIES

(75) Inventors: Nicholas Charles Parson; Jeffrey David Hankin; Kevin Paul Hicklin, all of Banbury (GB)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/355,497

(22) PCT Filed: Mar. 20, 1998

(86) PCT No.: PCT/GB98/00849

§ 371 (c)(1),
(2), (4) Date: Sep. 22, 1999

(87) PCT Pub. No.: WO98/42884

PCT Pub. Date: Oct. 1, 1998

(30) Foreign Application Priority Data

Mar. 21, 1997 (EP) ..... 97301911

(51) Int. Cl.[7] ..... C22C 21/08

(52) U.S. Cl. ..... 420/544; 148/689; 148/690; 148/417; 420/546; 420/547

(58) Field of Search ..... 148/689, 690, 148/417, 439; 420/534, 546, 547, 535, 544

(56) References Cited

U.S. PATENT DOCUMENTS

| | | | | |
|---|---|---|---|---|
| 3,879,194 A | * | 4/1975 | Morris et al. | 75/147 |
| 3,926,690 A | * | 12/1975 | Morris et al. | 148/32 |
| 4,256,488 A | * | 3/1981 | Livak | 75/142 |
| 4,729,939 A | * | 3/1988 | Nishikawa et al. | 430/278 |
| 5,571,347 A | * | 11/1996 | Bergsma | 148/550 |

FOREIGN PATENT DOCUMENTS

| | | | |
|---|---|---|---|
| GB | 1333327 | | 10/1973 |
| JP | 59-143039 | * | 8/1984 |
| JP | 2200750 | | 8/1990 |
| WO | WO9506759 | | 3/1995 |

OTHER PUBLICATIONS

Patent Abstracts Of Japan, vol. 014, No. 485, Abstract corresponding to Japanese Patent Publication No. JP2200750 published Aug. 9, 1990, and English translation of the Publication.

W. Gordon Barry, Rationalization of Structural Aluminum Magnesium–Silicide Extrusion Alloys, The Aluminium Association, Conference: E84: Extrusion Productivity Through Automation, vol. 84, No. 8, pp. 7–15, Apr. 26, 1984, XP 002036355.

W. Miller et al., The Effect Of Copper And Manganese On The Strength And Formability Of Al–Mg–Si Alloys, Georgia Institute Of Technology School Of Materials Science and Engineering, vol. 1, pp. 410–416, Sep. 11, 1994, XP 002036356.

J. Baumgarten, Investigation Of Some Steps In The Production Of Al–$Mg_2Si$ Extrusions With High Quality, The Aluminium Association, vol. 84, No. 8, pp. 45–48, Apr. 24, 1984, XP 002036357.

I. Musulin et al., Effect Of Mn On The Quench Sensitivity of 6063, Institute Of Metals And Materials Australasia, Conference: Materials Processing And Performance, vol. 92, No. 5, pp. 71–75, Sep. 2, 1991, XP 002036358.

* cited by examiner

*Primary Examiner*—George Wyszomierski
*Assistant Examiner*—Janelle Combs-Morillo
(74) *Attorney, Agent, or Firm*—Cooper & Dunham LLP

(57) ABSTRACT

An alloy of composition in wt. % (see table (I)) and incidental impurities up to 0.05 each 0.15 total, balance A1. The alloy can be extruded at high speed to provide extruded sections which meet T5 or T6 strength requirements.

19 Claims, 8 Drawing Sheets

AL-MG-SI ALLOY WITH GOOD EXTRUSION PROPERTIES

This invention concerns AlMgSi alloys of the 6000 series of the Aluminum Association Register. The compositions are low magnesium containing AlMgSi alloys with appropriate silicon and copper additions to meet the strength requirements of AA6063T5 and T6. AA6063 accounts for approximately 80% of all aluminium extruded products. At this bottom end of the extrusion market, there is a need for extrusions which meet the T5 or T6 strength requirements but which can be manufactured at the highest possible rates of extrusion.

This need was addressed in a paper by D Marchive in Light Metal Age, April 1983, pages 6–10. The author reported a trend towards reducing the content of $Mg_2Si$ and compensating for this by increasing the excess of Si, but that resulted in loss of formability. He reported new alloys in which the concentrations of Mg, Si, Cu, Mn and Cr were optimised to provide alloys which exhibited the required tensile properties but with superior extrudability, formability and toughness. The alloys had Mg contents in the range 0.35 to 0.60.

There has been a prejudice in the industry against reducing the Mg content of 6000 series general purpose extrusion alloys below 0.35 wt %. Of the 63 6000 series alloys listed in the Aluminum Association Register, all the general purpose extrusion alloys require a Mg content of at least 0.35 wt %.

WO 95/06759 describes high strength high extrudability AlMgSi Alloys having the composition in wt %: Mg 0.25–0.40; Si 0.60–0.90; Fe up to 0.35; Mn up to 0.35 preferably 0.10–0.25. But these are not general purpose extrusion alloys. By virtue of the high Si content they have high tensile strength generally in excess of 250 MPa and they preferably contain Mn to improve extrusion surface quality.

This invention concerns general purpose extrusion alloys having the minimum alloying additions required to meet the strength requirements of AA 6063T5 (peak aged tensile strength of at least about 152 MPa) and T6 (peak aged tensile strength of at least about 207 MPa). Decreasing the Mg content of such an alloy reduces the flow stress of the material at the temperatures used for extrusion, which in turn reduces the extrusion pressure and the work done in the process. Approximately 90% of the work of extrusion is converted to heat which results in temperature rise in the extruded product. With the dilute alloys described here, less heat is generated in the extrusion process as compared with conventional alloys, such that the product can be extruded at a higher speed before surface deterioration occurs. Usually the productivity of an aluminium extrusion is limited by the onset of various types of surface defect which is linked to the attainment of a critical temperature at the surface of the product.

The lower breakthrough pressure associated with the lower Mg content also means that for a given extrusion press, the initial billet temperature can be reduced until the pressure required matches the press capacity. This has the effect of further reducing the temperature of the product as it exits the die which gives further productivity benefits.

In one aspect the invention provides an alloy of composition in wt %

| | Broad | Narrow |
|---|---|---|
| Mg | 0.20–0.34 | 0.20–0.30 |
| Si | 0.35–0.60 | 0.40–0.59 |
| Mn | 0.15 max | 0.03–0.10 |
| Cu | 0.25 max | 0.20 max |
| Fe | 0.35 max | 0.25 max |

incidental impurities up to 0.05 each 0.15 total balance Al provided that when Mg is at least 0.30 and Cu is at least 0.05, then Fe is greater than 0.15.

The invention also provides extrusion ingots of the alloy as defined; and extrusions (i.e. extruded sections) made from such ingots.

Reference is directed to the accompanying drawings in which.

Figure 1:
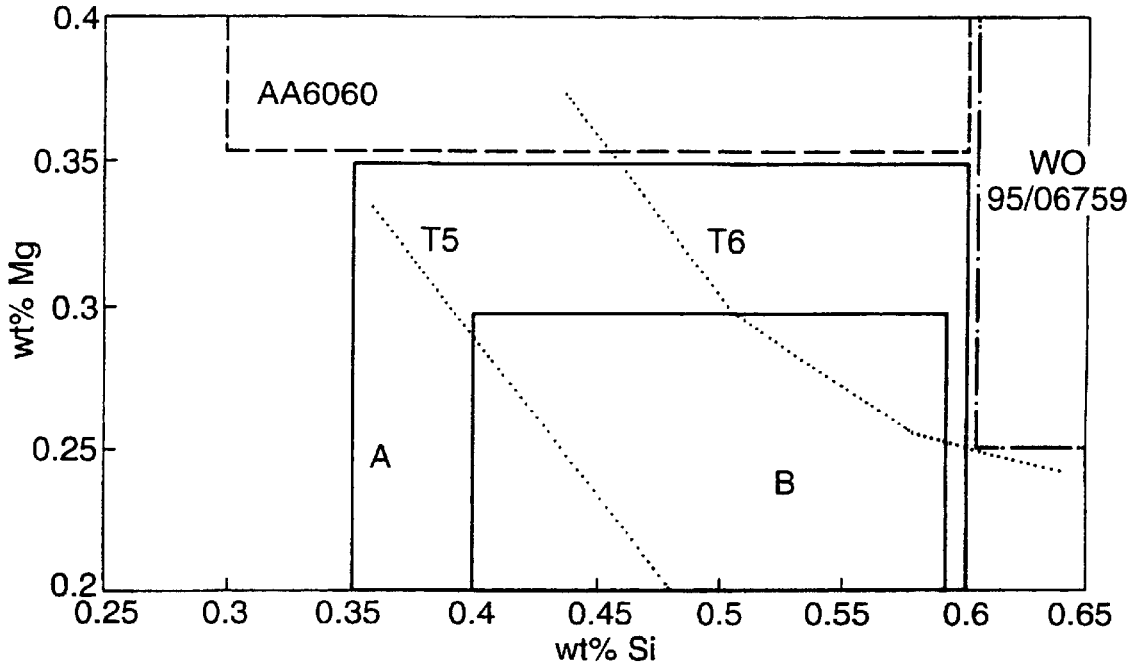
FIG. 1 is a graph showing Mg and Si concentrations of certain dilute 6000 alloys.

Referring to FIG. 1, the boxes marked A and B designate the broad and narrow compositions of alloys according to the invention as defined above. Also shown for comparison is the bottom end of a box for AA6060, a general purpose extrusion alloy; and the left hand side of a box for the high strength alloy described in WO 95/06759. Lines marked T5 and T6 represent the compositions required to produce extrusions capable of passing these tests. The positions of these lines are somewhat variable depending on ingot pretreatment conditions, rate of cooling the extrusions and extrusion ageing conditions.

The Mg content of the invention alloy is set at 0.20–0.34 preferably 0.20–0.30%. If the Mg content is too low, it is difficult to achieve the required strength in the aged extrusions. Extrusion pressure increases with Mg content, and becomes unacceptable at high Mg contents.

The Si content is set at 0.35–0.60 preferably 0.40–0.59. If the Si content is too low, the alloy strength is adversely affected, while if the Si content is too high, extrudability may be reduced. Formability has also been reported to be impaired at high Si levels, but it has been found that this effect is not important within the composition range of the invention. A function of the Si is to strengthen the alloy without adversely affecting extrudability, high temperature flow stress or anodising and corrosion characteristics.

The presence of Fe in the alloy is normally unavoidable. An upper concentration limit is set at 0.35, preferably 0.25%. It is likely to be preferred to use alloys containing at least 0.15% Fe, to prevent bright finish on anodising and because these alloys are less expensive than alloys containing lower Fe concentrations especially when made from remelted scrap. In the as-cast alloy ingots, Fe is present in the form of large plate-like β-AlFeSi particles. Preferably the extrusion ingot is homogenised to convert β-AlFeSi to substantially (at least 80% and preferably more than 90%) the α-AlFeSi form.

Mn has a number of different effects. Although it has previously been included in extrusion alloys to improve toughness, it is generally not useful for this purpose for alloys of the present invention. At very high levels, Mn gives rise to problems with quench sensitivity due to increased levels of dispersoid formation. To avoid this, Mn levels are preferably kept below 0.15% particularly below 0.10%.

The inventors have determined that, when included at a level of at least 0.02% preferably at least 0.03%, Mn has a hitherto unpublished technical effect. This is that silicon levels of about 0.50 wt % or greater lead to increased stability of the P-AlFeSi phase at homogenisation temperatures. This retards the transformation of the AlFeSi intermetallic from β to α during homogenisation. As a result, the break up of the intermetallics is retarded such that mean size of the intermetallic phases is increased and a degree of spheroidisation is reduced. This has detrimental effects on the extrudability of the material and causes poor surface finish. The effects of the silicon level on a stability can be avoided by adding an appropriate level of manganese to the alloy which stabilises the α form of the Al(Fe,Mn)Si intermetallic. Thus a preferred minimum manganese content can be expressed:

$$\text{Wt \% manganese} = \text{at least } 0.3 \times \text{wt \% silicon} - 0.12$$

Inclusion of manganese in these concentrations helps to: promote a β to α AlFeSi transformation during homogenisation such that at least an 80% and preferably at least 90% transformation is achieved under normal homogenising conditions; reduce the AlFeSi particle size (which is however also dependent on the diameter of the billet being homogenised); and increase the degree of AlFeSi spheroidisation, preferably to at least 0.5 or 0.51 (where 0 equals a rod and 1 equals a sphere).

Cu has the advantage of improving tensile strength without a comparable increase in extrusion breakthrough pressure; and a disadvantage of giving rise to corrosion problems. Particularly at low Si levels, Cu may be included in alloys of this invention at concentrations up to 0.25% preferably up to 0.20%, and particularly up to 0.10%.

The strength of extrusion alloys is sometimes expressed in terms of their $Mg_2Si$ content, which for excess Si alloys such as these may be calculated as Mg×1.57 . The $Mg_2Si$ content of alloys according to this invention is preferably 0.314–0.55 wt %, particularly 0.38–0.53 wt %.

Si is present in an excess over that required to combine with all Mg as $Mg_2Si$, and with all Fe and Mn as Al(Fe, Mn)Si. (The terms AlFeSi and Al(Fe,Mn)Si are conventionally used to denote intermetallics containing these elements but not necessarily in these proportions). Excess Si is calculated according to the following formula $$\text{Excess Si} = \text{Si} - \text{Mg}/1.73 - (\text{Fe}+\text{Mn})/3.$$

In alloys of the present invention, the excess Si is preferably 0.08–0.48 wt % particularly 0.12–0.40 wt %. Where this excess is too small, it will be difficult to achieve the required tensile strength properties. Where this excess is too large, alloy formability and extrusion surface quality may be adversely affected.

An extrusion ingot of the alloy of the invention may be made by any convenient casting technique, e.g. by a d.c. casting process, preferably by means of a short mould or hot-top d.c. process. The Fe is preferably present as an insoluble secondary phase in the form of fine β-AlFeSi platelets, preferably not more than 15 μm in length or, if in the α form, free from script and coarse eutectic particles.

The as-cast extrusion ingot is homogenised, partly to bring the soluble secondary magnesium-silicon phases into suitable form, to dissolve the silicon and partly to convert β-AlFeSi particles into substantially α-AlFeSi particles, preferably below 15 μm long and with 90% below 6 μm long. Homogenisation typically involves heating the ingot at more than 530° C. e.g. 550–600° C. for 30 minutes to 24 hours with higher temperatures requiring shorter hold times.

Cooling from homogenisation temperature should preferably be sufficiently fast to avoid the formation of coarse β-$Mg_2$ Si particles which would not redissolve during extrusion. It is preferred to cool the ingot at a rate of at least 150° C. per hour from homogenisation temperature down to a temperature not greater than 425° C. The ingot may be held for a few hours at a temperature in the range 300–425° C., as described in EP 222 479, in order to encourage the formation of a rather fine precipitate β'-$Mg_2Si$ which has the effect of reducing extrusion breakthrough pressure and of redissolving during extrusion so as to permit development of maximum tensile strength in age hardened extrusions. The rate of cooling below 300° C. is immaterial.

The homogenised extrusion ingot is then heated for extrusion. The solutionising treatment described in EP 302 623 may be used. As is conventional in the art, the initial billet temperature can be chosen to match the pressure capacity of the extrusion press being used. The emerging extrusion is cooled, either by water or forced air or more preferably in still air, and subjected to an ageing process in order to develop desired strength and toughness properties.

Ageing typically involves heating the extrusion to an elevated temperature in the range 150–200° C., and holding at that temperature for 1–48 hours, with higher temperatures requiring shorter hold times. As demonstrated in the experimental section below, the response of the extrusion to this ageing process depends significantly on the rate of heating. A preferred rate of heating is from 10–100° C. particularly 10–70° C. per hour; if the heating rate is too slow, low throughput results in increased costs; if the heating rate is too high, the mechanical properties developed are less than optimum. An effect equivalent to slow heating can be achieved by a two-stage heating schedule, with a hold temperature typically in the range of 80–140° C., for a time sufficient to give an overall heating rate within the above range. Holding the extrusion for 24 hours or more at room temperature is also beneficial.

When aged to peak strength, extrusions are capable of meeting the requirements of T5 (tensile strength of 152 MPa) or preferably of T6 (tensile strength of about 207 MPa) with improved press productivity. The reduced flow stress characteristics also make it possible to produce shapes such as high aspect ratio heat sinks that are difficult to produce in existing alloys. The basic features of the alloys can also be applied for bright dip applications, with appropriate additions of copper or for matt etching applications with appropriate control of the iron content. Some of the more dilute versions of the alloys are suitable for applications where low strength is acceptable but where good formability is required.

EXPERIMENTAL

The invention has been tested in the laboratory. A range of compositions listed in Tables 1 and 2 were DC cast as 100 mm diameter ingots. These covered the following ranges of composition:

| | |
|---|---|
| Mg | 0.23–0.48 wt % |
| Si | 0.39–0.61 wt % |
| Cu | 0.001–0.10 wt % |
| Fe | 0.17–0.19 wt % |
| Mn | 0.028–0.03 wt % |

The range of alloys included a control alloy based on a commercially available alloy 6060 (Example 11) and 6063.

The billets were homogenised using a practice of 2 hrs at 585° C. followed by cooling at 350° C./hr, which is a typical practice for Al-Mg-Si alloys. The alloys were then extruded using a 750 tonne, 100 mm diameter extrusion press. Billets were induction heated using a number of different practices and then extruded into a 50×3 mm flat strip, equivalent to an extrusion ratio of 52:1. The extrusion speeds used ranged from 12 to 40 m/min. Initially the billet was extruded using a billet temperature of 480° C. at an exit speed of 40 m/min giving an exit temperature of at least 510° C. The strip was still air cooled at 2° C./sec. After 24 hours the alloys were aged using the following practices:

1. 100° C./hr heat up, soak for 5 hrs at 185° C.
2. 50° C./hr heat up, soak for 5 hrs at 185° C.
3. 20° C./hr heat up, soak for 5 hrs at 185° C.
4. 100° C./hr heat up, soak for 5 hrs at 120° C. followed by 100° C./hr heat up, soak for 5 hrs at 185° C.

Figure 2:
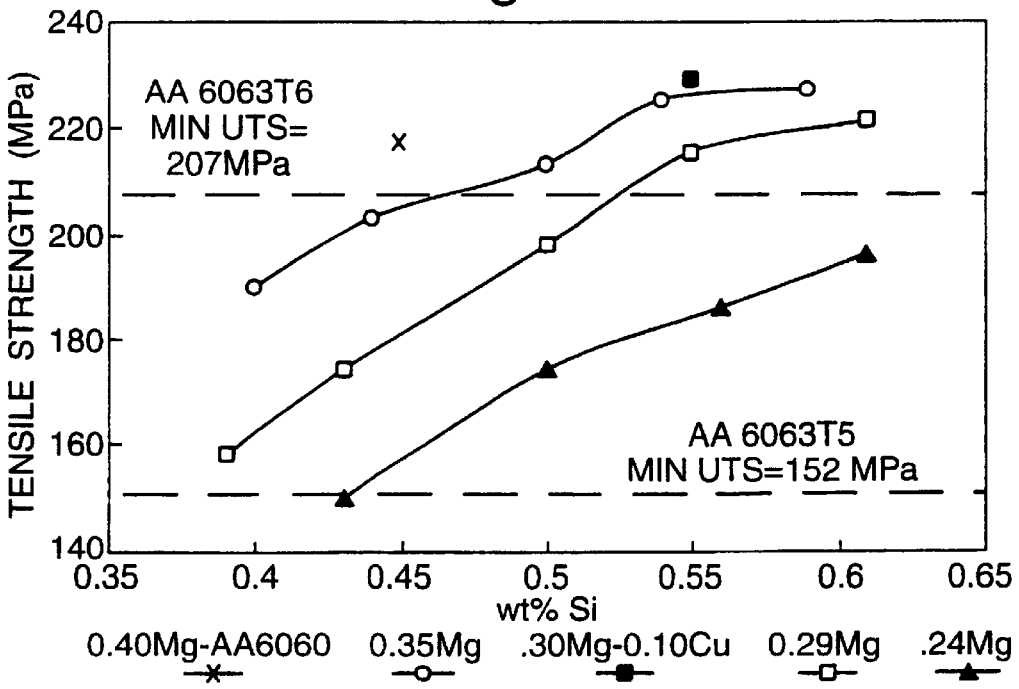
FIG. 2 is a graph of tensile strength against Si content for alloys of different composition.

FIG. 2 shows the tensile strengths obtained using the first heat treatment as a function of silicon and magnesium content. The requirements of the AA6063T5 and T6 specifications are shown. The following points can be drawn from this diagram, bearing in mind that the accepted alloy specification for most extruded applications is AA6063:

The minimum tensile strength requirement of AA6063T6 can be satisfied at magnesium levels of 0.29 and above with appropriate control of the silicon level. The strength obtained from such alloys is equivalent to the properties obtained with the alloy 6060.

The 6063T5 minimum tensile strength requirement can be easily met with all but the lowest Mg and Si compositions tested. This includes all the new 0.25 wt % Mg alloys tested apart from the lowest silicon level.

The addition of 0.10 wt % copper to a 0.29 wt % Mg alloy resulted in a 10 MPa increase in tensile strength. This indicates that it should be possible to meet the 6063T6 requirement at 0.25 wt % Mg-0.6 wt % Si by adding a similar level of copper.

Figure 3:
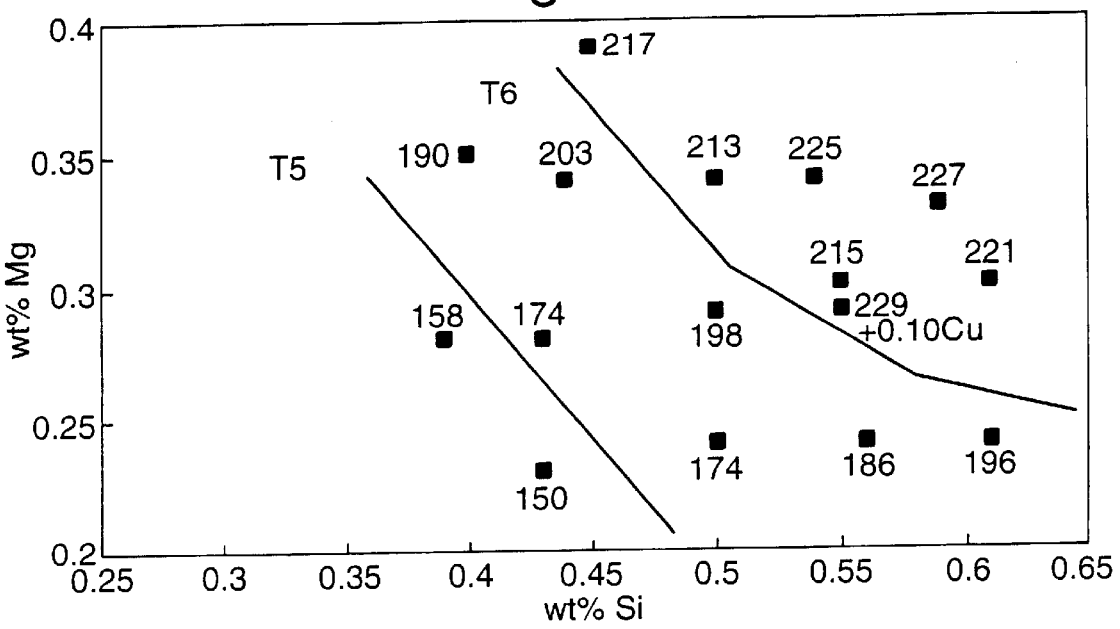
FIG. 3 is a graph showing T5 and T6 limits for various dilute 6000 alloys.

FIG. 1 showing alloy composition fields and strength contours have been reproduced as FIG. 3, in which are shown the compositions and tensile strengths of the various alloys listed in Table 1. From this graph it is evident that alloys containing as little as 0.20 wt % Mg can be formulated with suitably high Si contents to pass the T5 specification.

Figure 4:
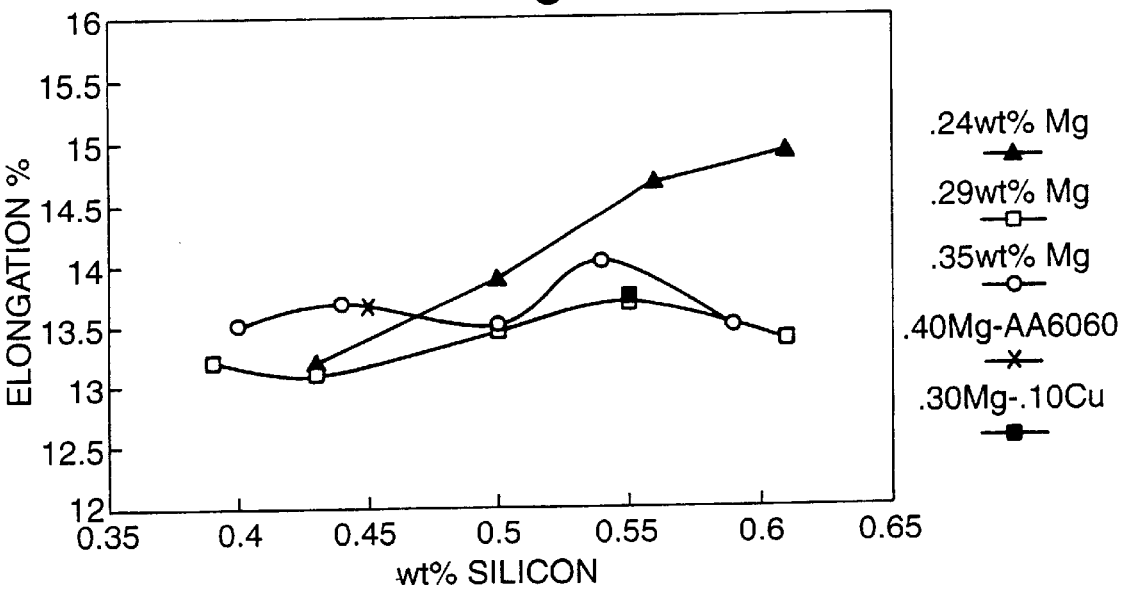
FIG. 4 is a graph showing elongation at break for alloys of different composition.

FIG. 4 is a graph of elongation at break for alloys of various compositions after ageing by practice 1. Elongation at break in a tensile test is one measure of formability. The following conclusions can be drawn from this figure:

Elongation did not decrease with increased excess Si and at the lowest Mg level (0.25 wt %) elongation increased only slightly with increasing Si.

The AA6060 control gave similar elongation values to the experimental alloys.

All the values were in excess of the minimum requirements, which are 8%, of AA6063T5 and T6.

The pressure requirements of the new alloy range have been compared with existing alloys AA6060 and AA6063 in the temperature range 400 to 475° C. In this case the alloys were extruded into a thin wall profile (1.3 mm thick I-section) at a reduction ration of 125:1. Individual billets were extruded at 400, 425, 450, 475° C. The experiments were carried out on a laboratory press as described previously. The press liner, die and tooling were preheated to the billet temperature in each case. The AA6063 composition is included in Table 1.

Figure 5:
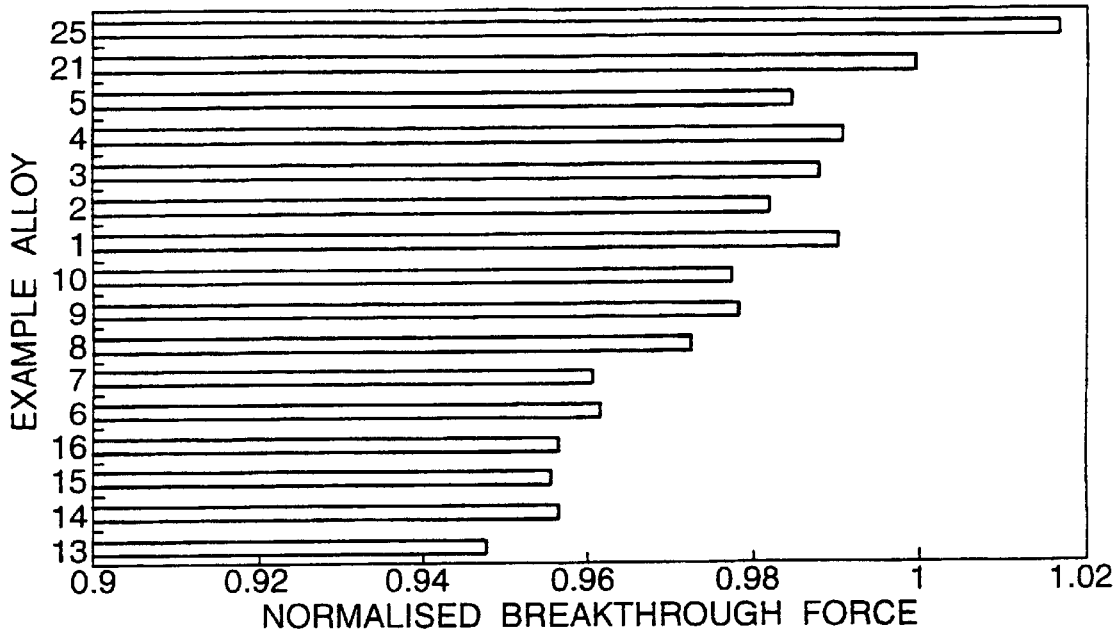
FIG. 5 is a bar chart showing relative mean extrusion breakthrough pressure for alloys of different composition.
Figure 6:
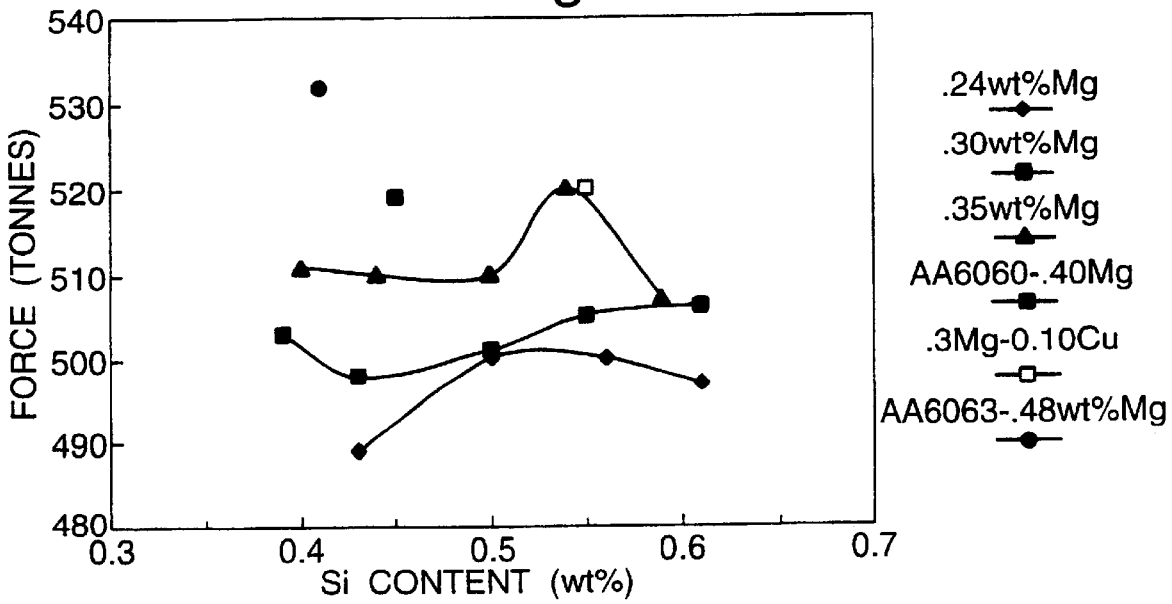
FIG. 6 is a graph showing extrusion breakthrough load at 450° C. for alloys of different composition.
Figure 7:
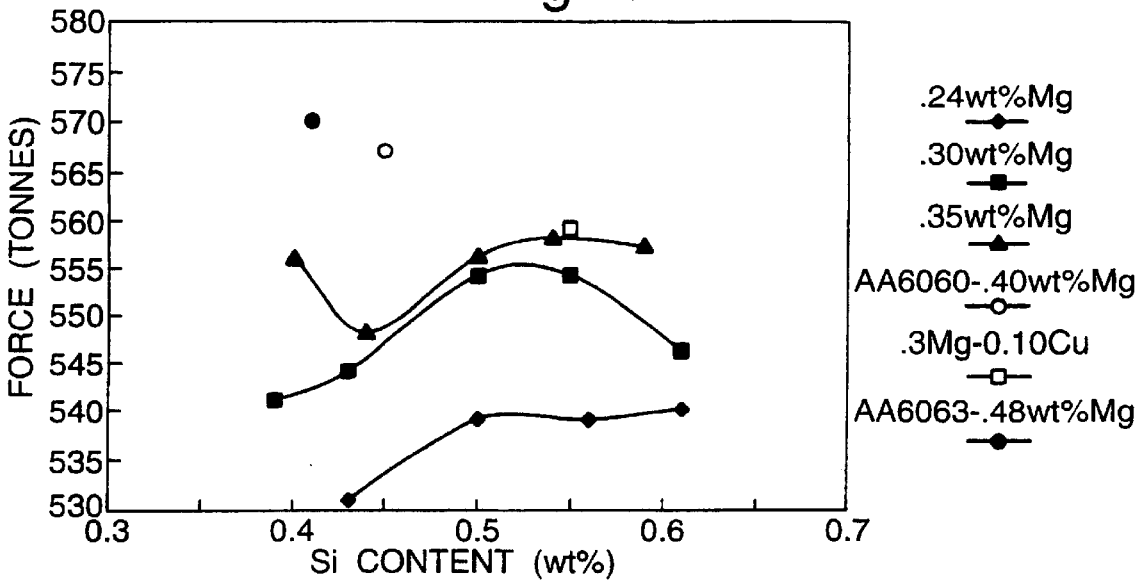
FIG. 7 is a graph showing extrusion breakthrough load at 425° C. for alloys of different composition.

FIG. 5 summarises the results expressed as mean breakthrough pressure over the temperature range 400–475° C. The alloys are ranked on the y-axis in terms of decreasing magnesium and silicon contents. There is a progressive decrease in pressure as the magnesium and silicon contents are reduced. All the alloys within the composition range covered by the invention offer useful pressure reductions as compared to conventional alloys AA 6060 and AA6063. As described above, these useful improvements in extrudability can be achieved whilst still satisfying the mechanical property requirements for to these types of applications. FIGS. 6 and 7 give more detailed pressure data for a typical extrusion temperatures of 450 and 425° C. The benefits of the new alloy range, in terms of reduced extrusion pressure, appear to increase as lower billet temperatures are utilised.

The addition of 0.10 wt % Cu to the 0.30 wt % Mg containing alloy does raise the extrusion pressure such that it is equivalent to adding 0.05 wt % Mg. From FIG. 2, it is also equivalent to an addition of 0.05 wt % Mg or 0.05 wt % Si in terms of mechanical properties and is still a useful way of controlling the mechanical properties.

Figure 8:
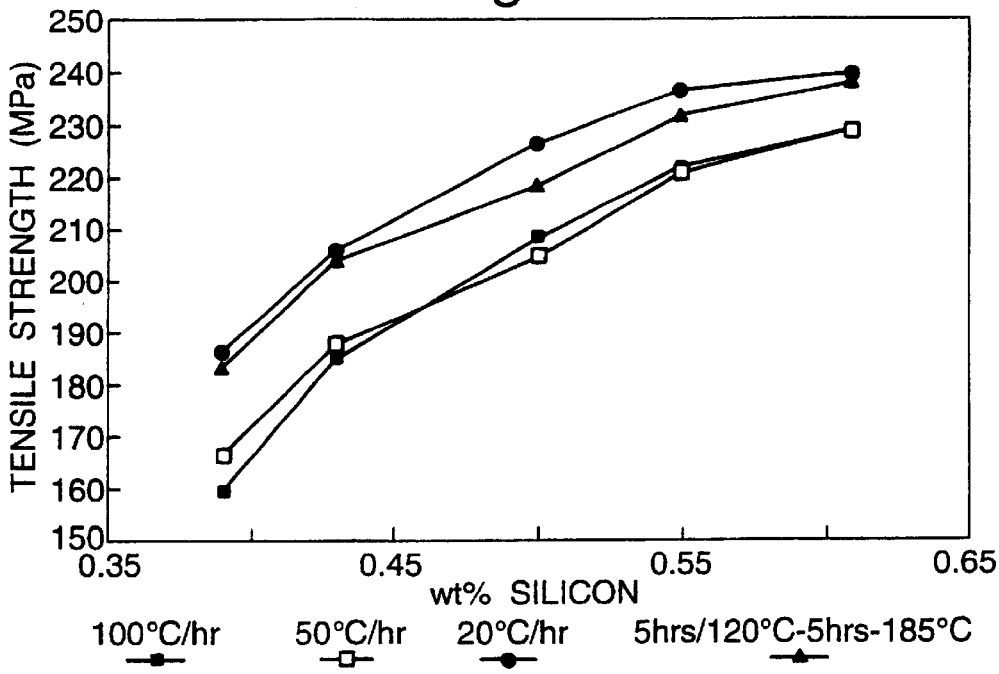
FIGS. 8 and 9 are graphs of tensile strength against Si content of two different alloys showing the effects of different ageing practices.
Figure 9:
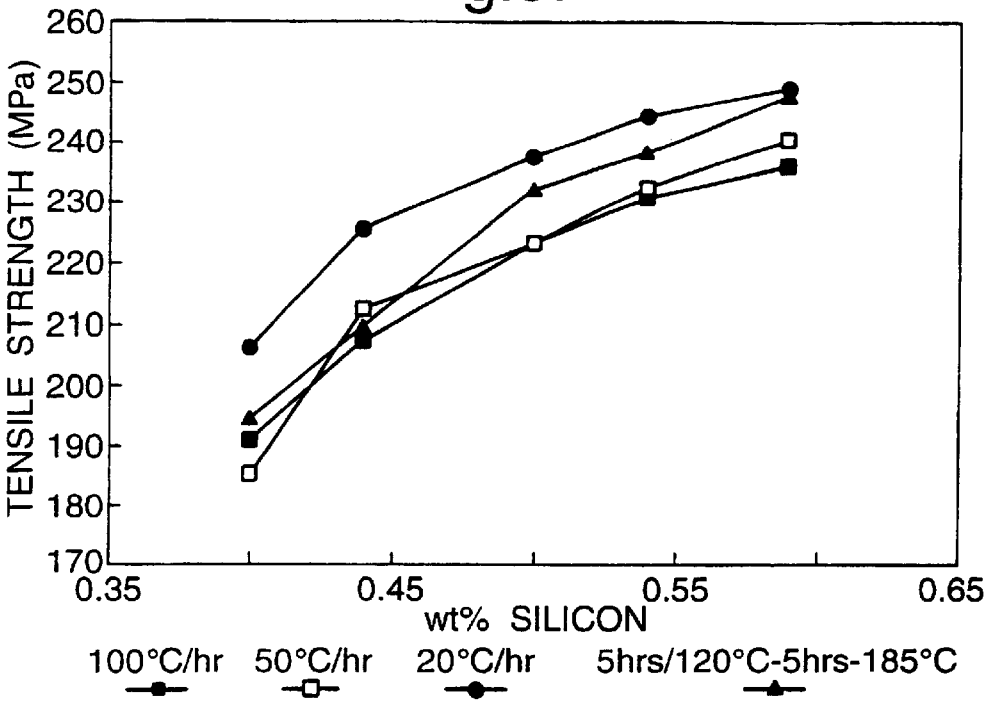

The effect of ageing practice on the properties achievable is shown in FIGS. 8 and 9, (in which extrusion ingots were solutionised by the technique described in EP 302623A). Further increases in strength are possible for all the compositions studied by reducing the heating rate to the ageing temperature to 20° C./hr (practice 3) or by using the two stage heat treatment (practice 4).

Figure 10:
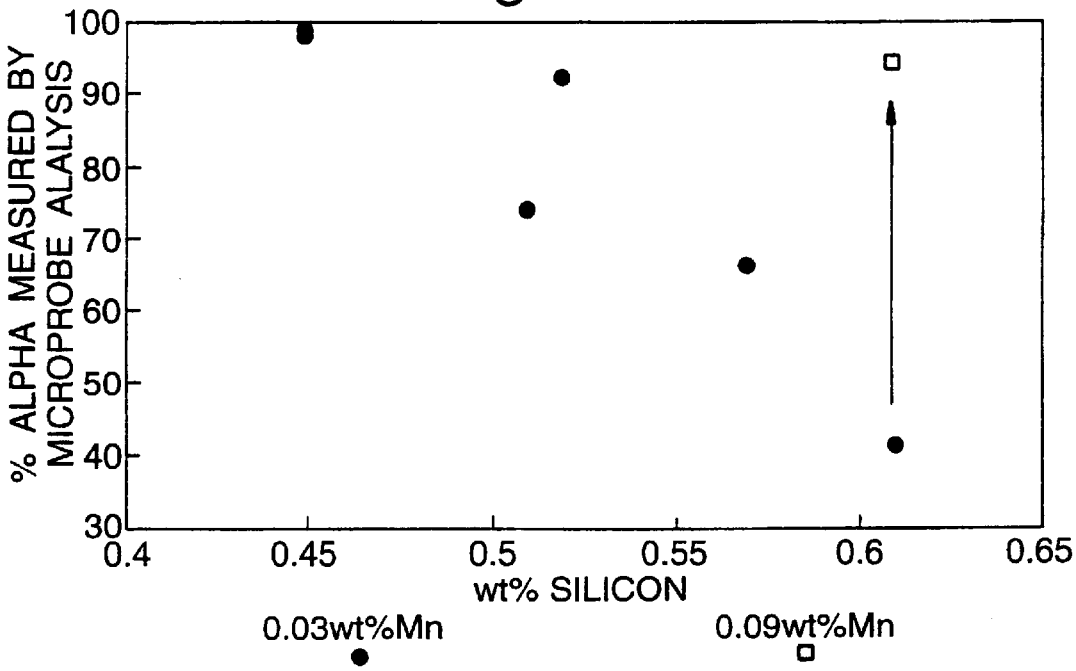
FIG. 10 is a graph showing the effect of silicon content on α–β transformation.
Figure 11:
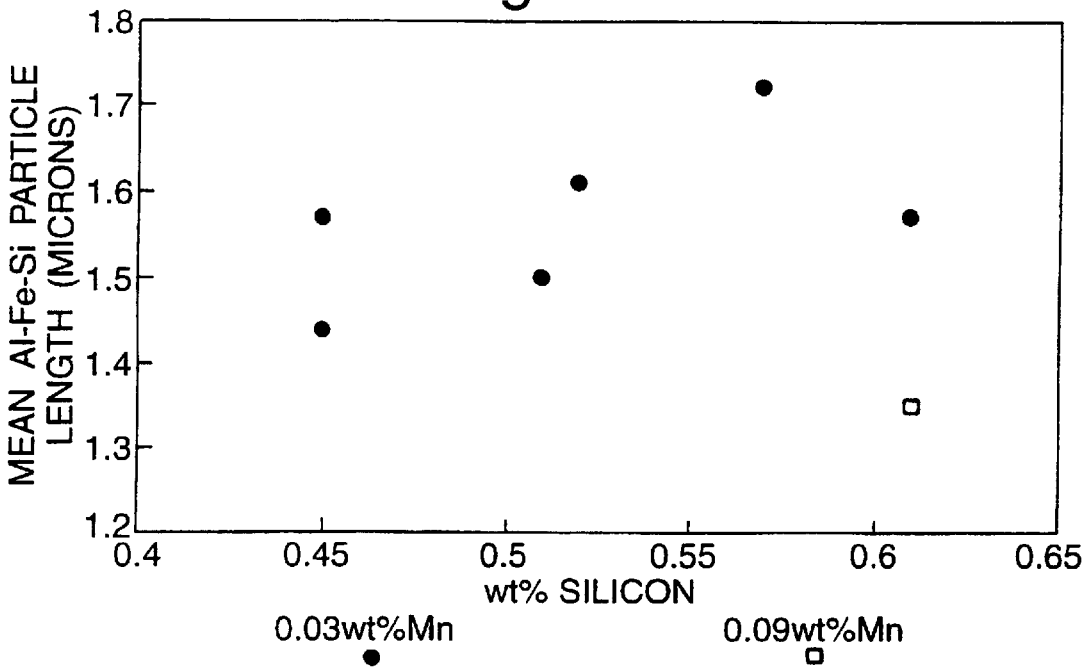
FIG. 11 is a graph showing the effect of silicon content on AlFeSi intermetallic size.
Figure 12:
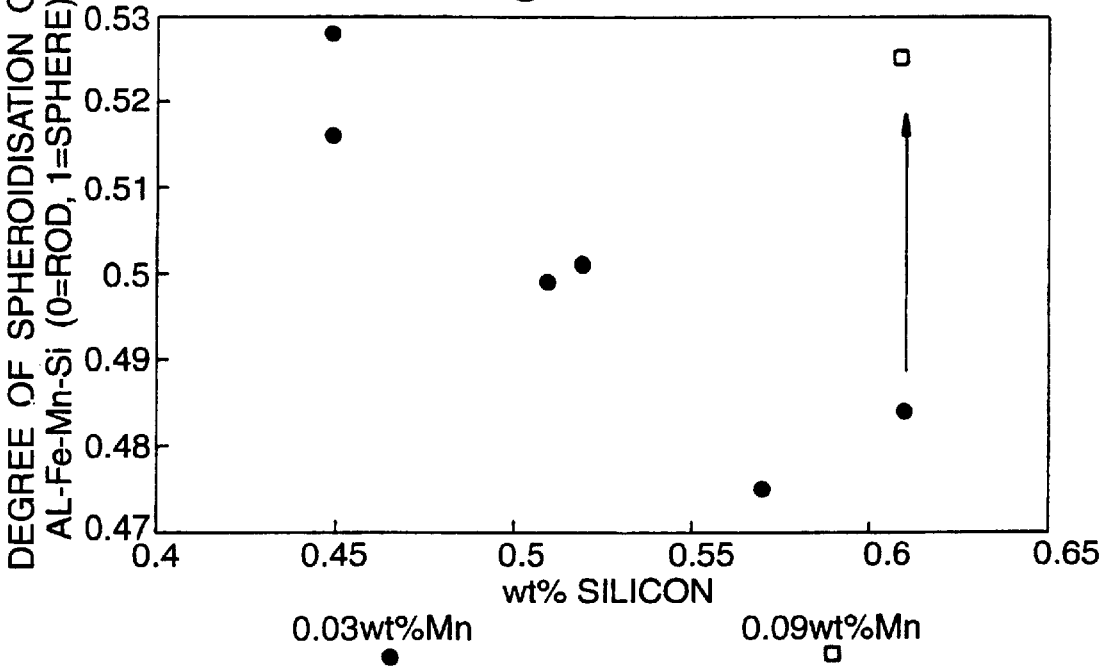
FIG. 12 is a graph showing the effect of silicon content on AlFeSi spheroidisation.

FIGS. 10 to 13 show the results of experiments performed by taking 178 mm diameter ingots of alloys according to the invention containing 0.25–0.50 wt % magnesium (the Mg content does not affect the results) and variable concentrations of silicon as shown; and subjecting the ingots to homogenisation under conventional conditions, typically 2 hours at 585° C. FIG. 10 shows the effect of increasing silicon levels on the percentage of β-AlFeSi remaining after homogenisation for ingots containing 0.03 wt % Mn. Above 0.5 wt % Si, the percent α-AlFeSi at the end of homogenisation is significantly reduced. FIGS. 11 and 12 show the mean size and degree of spheroidisation for the same alloys. The increase in residual β-AlFeSi at higher Si levels corresponds to an increase in particle size and lack of spheroidisation. In each of FIGS. 10, 11 and 12, a single further point shows that, by changing the Mn concentration from 0.03% to 0.09%, these detrimental effects on intermetalllic type, size and shape can be reversed.

Figure 13:
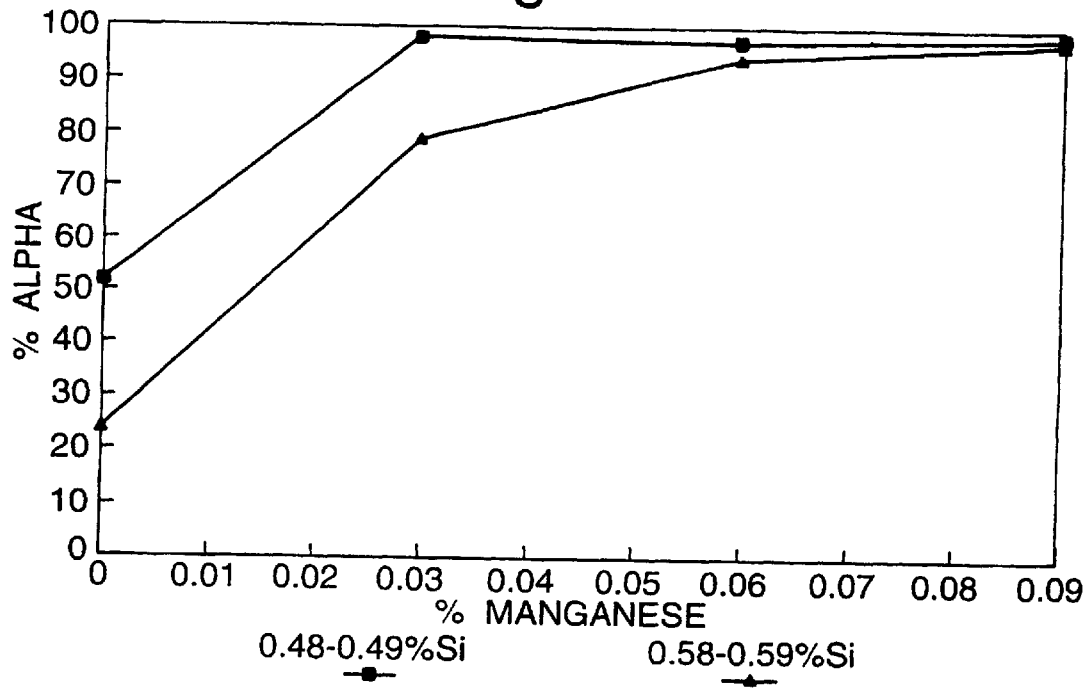
FIG. 13 is a graph showing the effect of Si and Mn levels on α–β transformation.

FIG. 13 shows the effect of incremental Mn additions on the level of β-AlFeSi remaining after standard homogenisation practice. Lines are shown for two Si levels of 0.50% and 0.60%. A target often used for homogenisation of dilute 6060 alloys is to achieve 90% α-AlFeSi after homogenisation. The amount of Mn required to achieve this increases with the bulk Si content. For alloys containing less than 0.50 wt % Si, a deliberate addition of Mn is not necessary to achieve this target, but the addition can still be useful in improving the extent of spheroidisation for a given homogenisation treatment.

Figure 14:
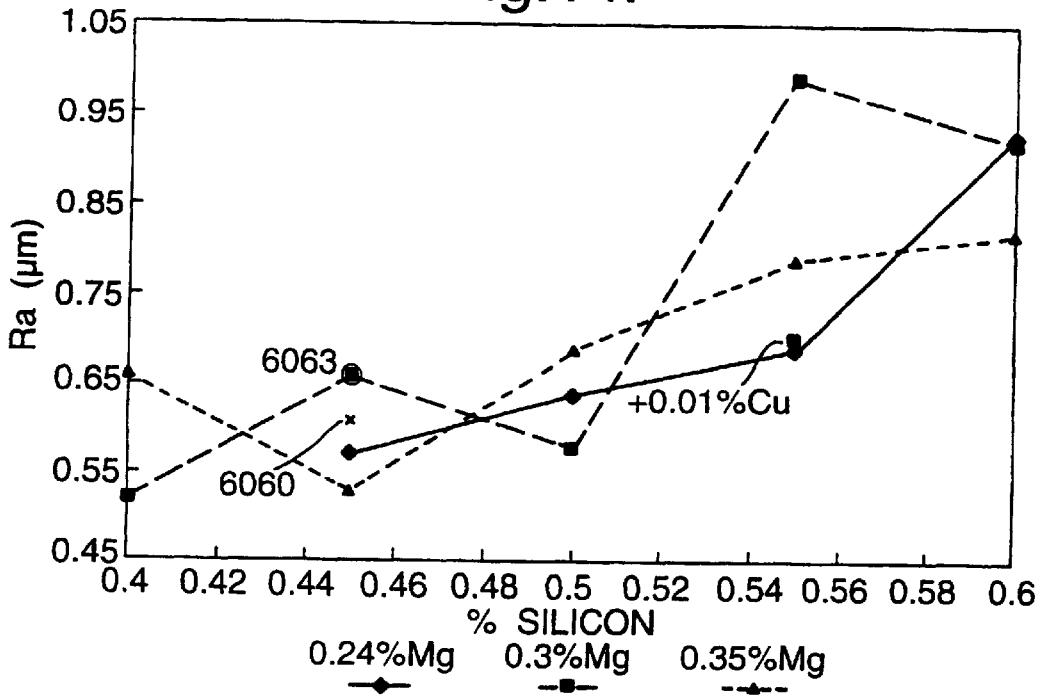
FIG. 14 is a graph showing the effect of Mg and Si content on roughness of extrusions according to the invention at an extrusion temperature of 450° C.

FIG. 14 is a graph showing the effect of Mg and Si content on roughness Ra of extrusions made from alloys shown in Table 1 at an extrusion temperature of 450° C. The exit speed was 100 m/min, the extrusion ratio was 125:1 and the section thickness was 1.3 mm. It can be seen that surface roughness begins to be a problem at Si levels above about 0.52 wt %.

Figure 15:
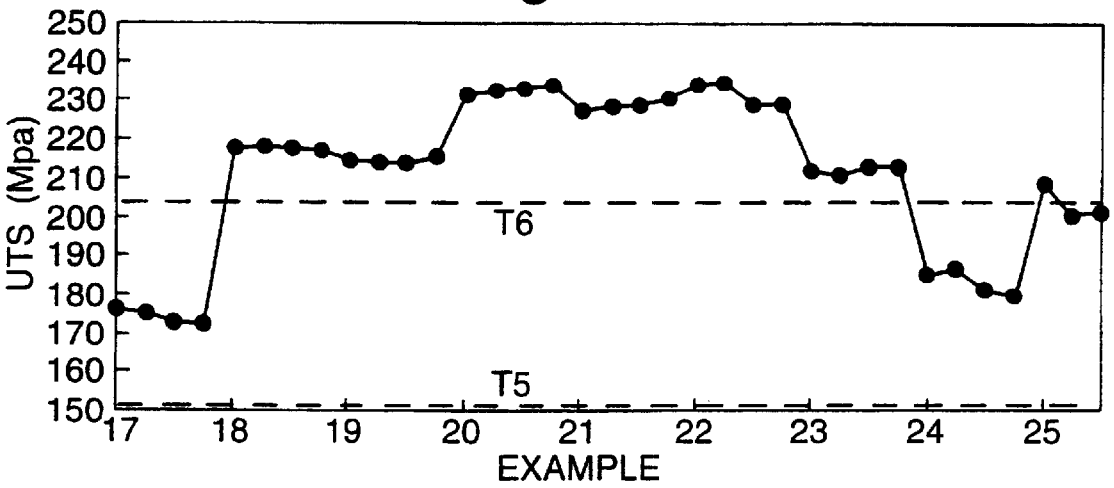
FIG. 15 is a graph showing the effect of alloy composition on tensile strength.

FIG. 15 is a chart showing the effect of alloy composition on tensile strength. Four ingots of each of nine different alloy compositions 17 to 25 as shown in Table 3 were extruded and aged and the UTS measured. The billet temperature was 450° C., the extrusion ratio was 125:1 and the quench rate was 3° C./s. Ageing was 5hr at 180° C. with a 100° C./hr heating rate. The results show that an alloy content of 0.31 wt % Mg and 0.53 wt % Si is close to the lower limit for achieving 6063 T6 properties. A comparison of Example alloys 18, 19 and 20 shows that Mn addition does not have any significant effect on strength.

Table 4 below provides further data on the extrusion properties of those example alloys 17 to 25: the load required to achieve extrusion at 100 metres/minute; and the roughness of the resulted extruded section. A comparison of example alloys 18, 19 and 20 shows that, at high Si levels, surface finish can be substantially improved by Mn addition.

A comparison of prior art alloys 21 and 25 with the others shows that the invention alloys require lower extrusion pressures.

TABLE 1

| Example No | % Si | % Fe | % Cu | % Mn | % Mg | % Zn | % Ti | % B |
|---|---|---|---|---|---|---|---|---|
| 1 | .40 | .18 | .002 | .029 | .35 | .007 | .008 | .001 |
| 2 | .44 | .17 | .001 | 0.030 | .34 | .007 | .008 | .001 |
| 3 | .50 | .17 | .001 | .029 | .34 | .007 | .008 | .001 |
| 4 | .54 | .17 | .002 | .029 | .34 | .007 | .008 | .001 |
| 5 | .59 | .17 | .002 | .029 | .33 | .006 | .007 | .001 |
| 6 | .39 | .17 | .001 | .029 | .28 | .006 | .007 | .001 |
| 7 | .43 | .17 | .001 | .029 | .28 | .007 | .007 | .001 |
| 8 | .50 | .17 | .002 | .029 | .29 | .007 | .007 | .001 |
| 9 | .55 | .17 | .002 | .029 | .30 | .007 | .007 | .001 |
| 10 | .61 | .17 | .002 | .029 | .30 | .007 | .008 | .001 |
| 11 | .45 | .17 | .001 | .029 | .39 | .007 | .007 | .001 |
| 12 | .55 | .17 | .10 | .029 | .29 | .007 | .007 | .001 |
| 13 | .43 | .19 | .001 | .028 | .23 | | .008 | .0010 |
| 14 | .50 | .19 | .001 | .028 | .24 | | .008 | .0010 |
| 15 | .56 | .19 | .002 | .029 | .24 | | .007 | .0010 |
| 16 | .61 | .19 | .002 | .029 | .24 | | .008 | .0010 |
| 6063 | .41 | .17 | | .03 | .48 | | .01 | |

TABLE 2

| Example | $Mg_2Si$ (wt %) | Excess Si (wt %) |
|---|---|---|
| 1 | .55 | .13 |
| 2 | .53 | .17 |
| 3 | .53 | .23 |
| 4 | .53 | .27 |
| 5 | .52 | .33 |
| 6 | .44 | .16 |
| 7 | .44 | .20 |
| 8 | .46 | .26 |
| 9 | .47 | .31 |
| 10 | .47 | .37 |
| 11 | .61 | .15 |
| 12 | .46 | .31 |
| 13 | .36 | .23 |
| 14 | .38 | .29 |
| 15 | .38 | .35 |
| 16 | .38 | .40 |
| 6063 | .75 | .06 |

TABLE 3

| Example | % Si | % Fe | % Cu | % Mn | % Mg | % Ti | % B | % Type |
|---|---|---|---|---|---|---|---|---|
| 17 | 0.4 | 0.18 | 0.002 | 0.029 | 0.35 | 0.008 | 0.001 | |
| 18 | 0.61 | 0.17 | 0.002 | 0.03 | 0.28 | 0.008 | 0.001 | |
| 19 | 0.62 | 0.17 | 0.002 | 0.09 | 0.27 | 0.008 | 0.001 | |
| 20 | 0.63 | 0.17 | 0.002 | 0.06 | 0.31 | 0.008 | 0.001 | |
| 21 | 0.45 | 0.17 | 0.002 | 0.03 | 0.41 | 0.007 | 0.001 | 6060 |
| 22 | 0.52 | 0.17 | 0.1 | 0.03 | 0.32 | 0.008 | 0.001 | |
| 23 | 0.53 | 0.17 | 0.003 | 0.03 | 0.31 | 0.008 | 0.001 | |
| 24 | 0.45 | 0.17 | 0.001 | 0.03 | 0.3 | 0.008 | 0.001 | |
| 25 | 0.41 | 0.17 | | 0.03 | 0.48 | 0.01 | | 6063 |

TABLE 4

| Example Alloy | Roughness Ra (μm) | Extrusion Load (tonnes) |
|---|---|---|
| 17 | — | |
| 18 | 1.10 | 507 |
| 19 | 0.44 | 507 |
| 20 | 0.69 | 510 |
| 21 | 0.81 | 522 |
| 22 | 1.08 | 511 |
| 23 | 1.12 | 508 |
| 24 | 0.80 | 509 |
| 25 | — | 532 |

What is claimed is:

1. A DC cast extrusion ingot of an alloy of composition consisting of 0.20–0.34 wt. % Mg, 0.35–0.60 wt. % Si, 0.02–0.15 wt. % Mn, up to 0.10 wt. % Cu, up to 0.35 wt. % Fe, optionally Ti and B as grain refiners, incidental impurities up to 0.05 wt. % each, up to 0.15 wt. % total, balance Al, provided that when Mg is at least 0.30 wt % and Cu is at least 0.05 wt %, then Fe is greater than 0.15 wt %.

2. An extrusion ingot as claimed in claim 1, wherein the alloy comprises 0.20 to 0.30 Mg.

3. An extrusion ingot as claimed in claim 1, wherein $Mg_2Si$ is present and the $Mg_2Si$ concentration is 0.35–0.55 wt % and an excess Si of 0.10–0.45 wt % is present.

4. An extrusion ingot as claimed in claim 1, wherein the wt % of Mn is at least (0.3×Si−0.12).

5. An extrusion ingot as claimed in claim 1, wherein the Fe content is at least 0.15 wt %.

6. An extrusion ingot as claimed in claim 1, in which Fe is present substantially as α-AlFeSi, by virtue of homogenisation.

7. An extrusion made from an ingot as claimed in claim 6.

8. An extrusion as claimed in claim 7, which has in the T6 temper an ultimate tensile strength of at least 207 MPa.

9. An extrusion as claimed in claim 8, which has been thermally aged, wherein the rate of heating for ageing is 10–100° C./hr.

10. A method of making an extrusion, comprising DC casting an extrusion ingot of an alloy of composition consisting of 0.20–0.34 wt. % Mg, 0.35–0.60 wt % Si, 0.02–0.15 wt. % Mn, up to 0.10 wt. % Cu, up to 0.35 wt. % Fe, optionally Ti and B as grain refiners, incidental impurities up to 0.05 wt. % each, up to 0.15 wt. % total, balance Al, provided that when Mg is at least 0.30 wt % and Cu is at least 0.05 wt %, then Fe is greater than 0.15 wt %; homogenising the ingot to convert β-AlFeSi particles to substantially an α-Al-Fe-Si form; cooling the homogenised ingot; and extruding the ingot.

11. A method as claimed in claim 10, wherein the alloy comprises 0.10 max Cu.

12. A method as claimed in claim 10, wherein the alloy comprises 0.20 to 0.30 Mg.

13. A method as claimed in claim 10, wherein the homogenisation is effected at 550° C.–600° C. for 30 minutes to 24 hours.

14. A method as claimed in claim 10, wherein the homogenisation ingot is cooled down to 425° C. or less at a rate of at least 150° C. per hour.

15. A method as claimed in claim 10, wherein the extrusion is age hardened by heating at 10–100° C./hr to an ageing temperature of 150–200° C.

16. A DC cast extrusion ingot of an alloy of composition consisting of 0.20–0.34 wt. % Mg, 0.40–0.59 wt. % Si, 0.03–0.10 wt. % Mn, up to 0.10 wt. % Cu, up to 0.35 wt. % Fe, optionally Ti and B as grain refiners, incidental impurities up to 0.05 wt. % each, up to 0.15 wt. % total, balance Al, provided that when Mg is at least 0.30 wt % and Cu is at least 0.05 wt %, then Fe is greater than 0.15 wt %; in which AlFeSi phase is present and more than 80% of said AlFeSi is present as α-AlFeSi, by virtue of homogenisation.

17. An extrusion ingot as claimed in claim 16 wherein more than 90% of said AlFeSi is present as α-AlFeSi, by virtue of homogenisation.

18. An extrusion ingot as claimed in claim 17 characterized in that an extrusion produced from the ingot, and aged to peak strength, has an ultimate tensile strength of at least 207 MPa.

19. An extrusion ingot as claimed in claim 16 characterized in that an extrusion produced from the ingot, and aged to peak strength, has an ultimate tensile strength of at least 207 MPa.

* * * * *

US006440359C1

(12) EX PARTE REEXAMINATION CERTIFICATE (6123rd)

United States Patent

Parson et al.

(10) Number: US 6,440,359 C1

(45) Certificate Issued: Feb. 19, 2008

(54) AL-MG-SI ALLOY WITH GOOD EXTRUSION PROPERTIES

(75) Inventors: Nicholas Charles Parson, Banbury (GB); Jeffrey David Hankin, Banbury (GB); Kevin Paul Hicklin, Banbury (GB)

(73) Assignee: Alcan International Limited, Montreal, Quebec (CA)

Reexamination Request:
No. 90/006,951, Feb. 24, 2004

Reexamination Certificate for:

| | |
|---|---|
| Patent No.: | **6,440,359** |
| Issued: | **Aug. 27, 2002** |
| Appl. No.: | **09/355,497** |
| Filed: | **Sep. 22, 1999** |

(22) PCT Filed: Mar. 20, 1998

(86) PCT No.: PCT/GB98/00849

§ 371 (c)(1), (2), (4) Date: Sep. 22, 1999

(87) PCT Pub. No.: WO98/42884

PCT Pub. Date: Oct. 1, 1998

(30) Foreign Application Priority Data

Mar. 21, 1997 (EP) ..... 97301911

(51) Int. Cl.

| | |
|---|---|
| ***C22F 1/05*** | (2006.01) |
| ***C22F 21/02*** | (2006.01) |
| ***C22F 1/043*** | (2006.01) |

(52) U.S. Cl. ..... 420/544; 148/417; 148/689; 148/690; 420/546; 420/547

(58) Field of Classification Search ..... None
See application file for complete search history.

(56) References Cited

U.S. PATENT DOCUMENTS

| | | | | | |
|---|---|---|---|---|---|
| 3,879,194 | A | * | 4/1975 | Morris et al. | 420/535 |
| 3,926,690 | A | * | 12/1975 | Morris et al. | 148/439 |
| 4,256,488 | A | * | 3/1981 | Livak | 420/534 |
| 4,729,939 | A | * | 3/1988 | Nishikawa et al. | 430/278.1 |
| 4,808,247 | A | | 2/1989 | Komatsubara et al. | |
| 4,814,022 | A | | 3/1989 | Constant et al. | |
| 5,223,050 | A | | 6/1993 | Bryant et al. | |
| 5,232,788 | A | * | 8/1993 | Timsit et al. | 428/560 |
| 5,525,169 | A | | 6/1996 | Murtha | |
| 5,571,347 | A | * | 11/1996 | Bergsma | 148/550 |
| 5,690,758 | A | | 11/1997 | Oh et al. | |

FOREIGN PATENT DOCUMENTS

| | | | |
|---|---|---|---|
| BE | 906 107 A | | 4/1987 |
| CA | 1217663 | | 2/1987 |
| EP | 0 104 139 A | | 3/1984 |
| EP | 0 222 479 A | | 5/1987 |
| EP | 0 302 623 A | | 2/1989 |
| EP | 0 480 402 A | | 4/1992 |
| EP | 0716716 | | 6/1996 |
| GB | 1333327 | * | 10/1973 |
| JP | 54 32111 | | 3/1979 |
| JP | 59-143039 | * | 8/1984 |
| JP | 61 136650 | | 6/1986 |
| JP | 2200750 | * | 8/1990 |
| JP | 8060313 | | 3/1996 |
| WO | WO95/06759 | * | 3/1995 |
| WO | WO 95/14113 | | 5/1995 |

OTHER PUBLICATIONS

Patent Abstracts of Japan, vol. 014, No. 485, Abstract corresponding to Japanese patent Publication No. JP2200750 published Aug. 9, 1990, and English translation of the publication.*

(Continued)

*Primary Examiner*—Jerry D. Johnson

(57) ABSTRACT

An alloy of composition in wt % (see table (I)) and incidental impurities up to 0.05 each 0.15 total, balance Al. The alloy can be extruded at high speed to provide extruded sections which meet T5 or T6 strength requirements.

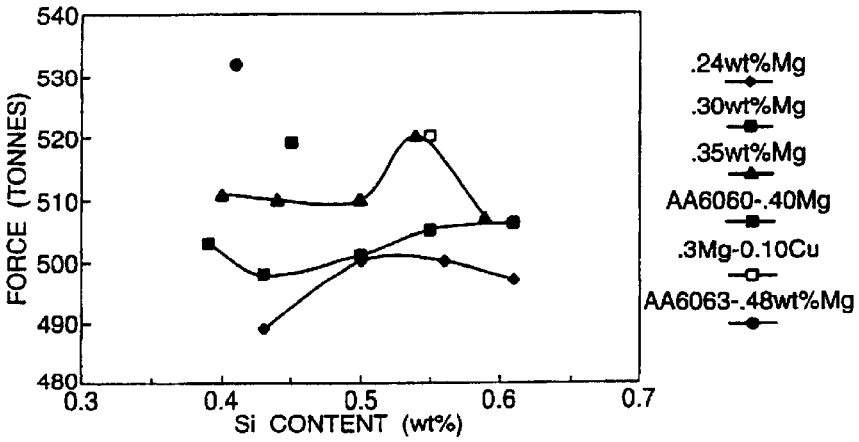

OTHER PUBLICATIONS

W. Miller et al, The effect Of Copper and Manganese On the Strength And Formability of Al–Mg–Si Alloys, Georgia Institute Of Technology School Of Materials Science and Engineering, vol. 1 pp. 410–416, Sep. 11, 1994, XP 002036356.*

J. Baumgarten, Investigation Of Some Steps In The Production Of Al–Mg2–Si Extrusions With High Quality, The Aluminum Association, vol. 84, No. 8, pp. 45–48, Apr. 24, 1984 XP 002036357.*

I. Musulin et al, Effect Of Mn On The Quench Sensitivity of 6063, Institute Of Metals And Materials Australasia, Conference: Materials Processing And Performance, vol. 92, No. 5 pp. 71–75, Sep. 2, 1991, XP 002036358.*

O. Reiso, "The Effect of Composition and Homogenization Treatment on Extrudability of AlMGSi Alloys," Proc. 3rd International Aluminum Extrusion Technology Seminar, Dec. 1984, vol. 1, pp. 31–40.

H. Bichsel et al., Metallographic investigations on the influences of small additions of manganese to AlMgSi 0.5 alloys, Proc. 7 International Light Metals Congress, Dec. 1981, pp. 68–69 (+ translation).

K. Matsuda et al, "Effect of deformation on age–hardening in Al–Mg2Si: alloys," 85th Conf. Japan Inst. Light Metals, Dec. 1993, pp. 121–122 (+ abstract).

D. Marchive, "High Extrudability Alloys in the 6000 series," Light Metal Age, Apr. 1983, pp. 6–10.

S. Zajac et al., "Microstructure Control and Extrudability of Al–Mg–S: alloys micro–alloyed with manganese," Materials Science & Technology, Apr. 1994 vol. 10, pp. 323–333.

C. Devradas et al., "Prediction of the Microstructure of DC Cast 6063 Billets and its effect on Extrusion Processes," Proc. 5th International Aluminum Extrusion Technology Seminar, vol. 1, May 1992, p. 124.

L. Gullman et al., "The Influence of Small Mg Additions and Heat Treatment Practice on the Extrudability of AA6005 Aluminum Alloy," Proc. 5th International Aluminum Extension Technology Seminar, vol. 2, May 1992, pp. 71–77.

O. Reiso, "The Effect of Homogenization Treatment on the Microstructure and Properties of Aluminum Extrusion Ingots," in E. Lossack, Stranggeisen, Informationge—sellschaft Verlag Dec. 1995, pp. 199–208.

Zajac et al., "Microstructure control and extrudability . . . ," Journal de Physique IV (supp. to J. de Physique III, vol. 3, Nov. 1993), pp. 251–254.

Parson et al., "The Effect of Heat Treatment on the Microstructure . . . ," Light Metals 1989, pp. 713–724 [1988], Dec. 1988.

Musulin et al., "Selection of 6XXX Alloys Based on Extrudability . . . ," Extrusion Tech. '92, vol. II, pp. 25–33 [1992], Dec. 1992.

Buratti et al., "Structural Profiles of 6000 Alloys Used in the . . . ," Extrusion Tech. '92, vol. II, pp. 101–111 [1992], Dec. 1992.

Musulin et al., "Effect of Mn on the Quench Sensitivity of 6063," Materials Processing and Performance, 1991, pp. 71–75, Dec. 1991.

Langerweger, "Influence of Heat Treatment Practice on Extrudability . . . ," Aluminum Technology 1986, pp. 216–222, Dec. 1986.

Annenkoff et al., "Properties of 6106 and 6005A Extrusion Alloys," Extrusion Tech. '84, vol. I, pp. 69–73 [1984], Dec. 1984.

Barry, "Rationalization of Structural Aluminum Magnesium–Silicide . . . ," Extrusion Tech '84, vol. I, pp. 7–15 [1984], Dec. 1984.

Van Horn, Aluminum, vol. 1 (ASM, 1967), p. 99, Dec. 1967.

Mondolfo, Aluminum Alloys: Structure and Properties (Butterworths, 1976), pp. 534–536, Dec. 1976.

Altenpohl, Un regard a l'interieur de l'Aluminium (Aluminium–Verlag, 1976), p. 177, Dec. 1976.

Zoller et al., "Metallkundliche Gesichtspunkte bei der Entwicklung . . . ," Z. Metallkunde 62 (5), pp. 354–358 (Dec. 1971).

Develay, "Traitements thermiques des alliag[es] d'aluminium," Techniques de l'ingenieur Jan. 1986, pp. M1290–M1291.16.

ASM Specialty Handbook, Aluminum and Aluminum Alloys, pp. 10, 22–23, ASM Materials Park OH, Dec. 1993.

Papers from European Patent Office opposition to EP 0 716 716 B1, May 1999.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 16–19 is confirmed.

Claim 6 is cancelled.

Claims 1, 7 and 10 are determined to be patentable as amended.

Claims 2–5, 8, 9 and 11–15, dependent on an amended claim, are determined to be patentable.

New claim 20 is added and determined to be patentable.

1. A DC cast extrusion ingot of an alloy of composition consisting of 0.20-0.34 wt. % Mg, 0.35-0.60 wt. % Si, 0.02-0.15 wt. % Mn, up to 0.10 wt. % Cu, up to 0.35 wt. % Fe, optionally Ti and B as grain refiners, incidental impurities up to 0.05 wt. % each, up to 0.15 wt. % total, balance A1, provided that when Mg is at least 0.30 wt % and Cu is at least 0.05 wt %, then Fe is greater than 0.15 wt %, *wherein excess Si, as defined by the formula*

$$Excess\ Si = Si - (Mg/1.73) - [(Fe+Mn)/3],$$

*is present in said composition, and wherein Fe is present in the ingot substantially as α-AlFeSi, by virtue of homogenisation.*

7. An extrusion made from an ingot as claimed in claim [6] *1*.

10. A method of making an extrusion, comprising DC casting an extrusion ingot of an alloy of composition consisting of 0.20-0.34 wt. % Mg, 0.35-0.60 wt. % Si, 0.02-0.15 wt. % Mn, up to 0.10 wt. % Cu, up to 0.35 wt. % Fe, optionally Ti and B as grain refiners, incidental impurities up to 0.05 wt. % each, up to 0.15 wt. % total, balance A1, provided that when Mg is at least 0.30 wt % and Cu is at least 0.05 wt %, then Fe is greater than 0.15 wt %; homogenising the ingot to convert β-AlFeSi particles to substantially an α-Al-Fe-Si form; cooling the homogenised ingot; and extruding the ingot, *wherein excess Si, as defined by the formula*

$$Excess\ Si = Si - (Mg/1.73) - [(Fe+Mn)/3],$$

*is present in said composition.*

*20. A method according to claim 10, wherein said composition consists of 0.20-0.34 wt. % Mg, 0.40-0.59 wt. % Si, 0.03-0.10 wt. % Mn, up to 0.10 wt. % Cu, up to 0.35 wt. % Fe, optionally Ti and B as grain refiners, incidental impurities up to 0.05 wt. % each, up to 0.15 wt. % total, balance Al, provided that when Mg is at least 0.30 wt % and Cu is at least 0.05 wt %, then Fe is greater than 0.15 wt %; in which AlFeSi phase is present and more than 80% of said AlFeSi is present as α-AlFeSi, by virtue of homogenisation.*

* * * * *